US007484467B1

(12) United States Patent
Bottomy

(10) Patent No.: US 7,484,467 B1
(45) Date of Patent: Feb. 3, 2009

(54) DEEP WATER LIFT SYSTEM REMOTE PENDANT

(75) Inventor: Chris Bottomy, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 340 days.

(21) Appl. No.: 11/152,727

(22) Filed: Jun. 15, 2005

(51) Int. Cl.
*B63C 7/00* (2006.01)

(52) U.S. Cl. ..... 114/51

(58) Field of Classification Search ..... 114/50, 114/51; 254/323
See application file for complete search history.

(56) References Cited

U.S. PATENT DOCUMENTS 2,953,627 A * 9/1960 Malneritch et al. ..... 174/102 R
3,629,963 A * 12/1971 Itami ..... 37/313
4,003,620 A * 1/1977 O'Brien et al. ..... 439/204
4,805,981 A * 2/1989 Gould ..... 385/104
5,043,538 A * 8/1991 Hughey et al. ..... 174/107
5,072,962 A * 12/1991 Webb ..... 280/414.1
5,522,582 A * 6/1996 Dilks ..... 254/323
5,820,109 A * 10/1998 Jermyn et al. ..... 254/362

* cited by examiner

*Primary Examiner*—Stephen Avila
(74) *Attorney, Agent, or Firm*—James T. Shepherd

(57) ABSTRACT

A control pendant for raising and lowering an object in water by hoist machinery allows control by a diver viewing the submerged object. The pendant has an elongate sheath defining an elongate interior extending between bitter and distal ends. The bitter end is coupled to the hoist machinery and the sheath has a length to extend below to the object. Control lines extend within the length of the elongate sheath and a first end of each control line is connected to the hoist machinery. The remainder of the sheath is filled with filler material. A watertight control housing is connected to the sheath at the distal end and contains a pair of switches that are each connected to a separate one of second ends of the lines. Sealed control buttons extend from the switches for selectively raising and lowering of said object by a percipient diver.

12 Claims, 3 Drawing Sheets

DEEP WATER LIFT SYSTEM REMOTE PENDANT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to an apparatus for controlling a lift system for recovering submerged objects. More particularly, this invention extends from and below a buoyant lift system for controlling the raising and lowering of a submerged object by a diver within viewing distance of the submerged object.

Floating structures, such as barges, pontoons and other boat-like craft have been used to support powered hoists for raising and lowering objects such as instrumentation modules, machinery, small craft, ordnance, etc., that rest on the bottom of a body of water. Hoist lines attached to the objects can bring them up to the surface zone for recovery or be used to transport them to another undersea location. The recovery or relocation procedure usually calls for: 1) locating the submerged object by sonar or visual means, 2.) moving a flotation unit carrying a hoist mechanism to a position above the object, 3.) attaching a hoist line to the object by a diver, 4.) indicating by the diver that attachment has been made by visually signaling at the surface or tugging on a messenger line extending to the flotation unit or a tethered support vessel, and 5.) raising the object above the bottom by the hoist mechanism for recovery. When an object is to be relocated or work is to be done on it at a remote site, the procedure can include: 6.) moving the flotation unit to another location, 7.) avoiding hidden submerged obstacles on the way to the other location, and 8.) lowering the object until it contacts the bottom.

Care must be taken during the initial stages of this procedure to avoid rapid or uneven, accelerations that may impart a snapping displacement of the object. These accelerations can be created as the object is being extracted or pulled from the bottom since increased levels of pulling force often are needed to extract or pull the object loose from marine sediment at the bottom (as compared to the lesser amounts of force subsequently required for supporting and raising the object in the water). The increased levels of force could rupture or tear apart some relatively delicate instrumentation packages or the unwanted accelerations created by excessive force could disengage the object from the hoist line and damage it as it impacts the bottom.

Under the current salvage procedure outlined above, the hoist mechanism is not capable of being controlled in real time to provide for specifically changed forces that are tailored to avoid excessive hoisting forces and/or snapping accelerations during the extraction of the object. Furthermore, additional precise vertical displacements of the object being recovered may need to be made to avoid other submerged obstacles or to interface it with other devices. Consequently, the current procedure can create hazardous conditions for personnel and machinery associated with the recovery operation.

Thus, in accordance with this inventive concept, a need has been recognized in the state of the art for a control depending from a hoist mechanism on a flotation unit that permits controlled raising and lowering of an object from the bottom by a percipient diver in close proximity to the object throughout the procedure.

SUMMARY OF THE INVENTION

The present invention provides for a system for controlling the raising and lowering of an object in water. A flotation unit is positioned above a submerged object. Hoist machinery mounted on the flotation unit has an operatively interconnected power supply, motor and winch mounting a cable for raising and lowering the object. A control pendant has a bitter and distal end, and the bitter end is coupled to the hoist machinery. The control pendant has a length to extend below and from said flotation unit to the object and has an elongate sheath defining an elongate interior extending between the bitter and distal ends. Insulated electrically conductive control lines extend the length of the elongate sheath. Each line has first and second ends, and the first end of each control line is connected to the hoist machinery. Filler material fills the remainder of the elongate interior, and a watertight control housing is connected to the elongate sheath at the distal end. A pair of switches is provided in the housing, and a separate one of the switches is each connected to a separate one of the second ends of the lines in the housing. Sealed control buttons extend from the switches and selective depression of the buttons by a diver percipient of the submerged object enables selective raising and lowering of the object.

An object of the invention is to provide a means to improve raising and/or lowering procedures for objects at a submerged work site.

Another object is to provide a control pendant for raising and lowering of submerged objects by a percipient diver.

Another object of the invention is to provide an improved control pendant for raising and lowering procedures performed by a percipient diver at the submerged work site.

Another object of the invention is to provide an improved control pendant to enable selective raising and lowering of submerged objects by hoist machinery under the control of a percipient diver at the submerged work site.

Another object of the invention is to provide an improved control for a lift mechanism operated by a percipient diver at the submerged work site that is coupled in parallel with topside controls.

These and other objects of the invention will become more readily apparent from the ensuing specification when taken in conjunction with the appended claims.

DESCRIPTION OF THE PREFERRED EMBODIMENT

Figure 1:
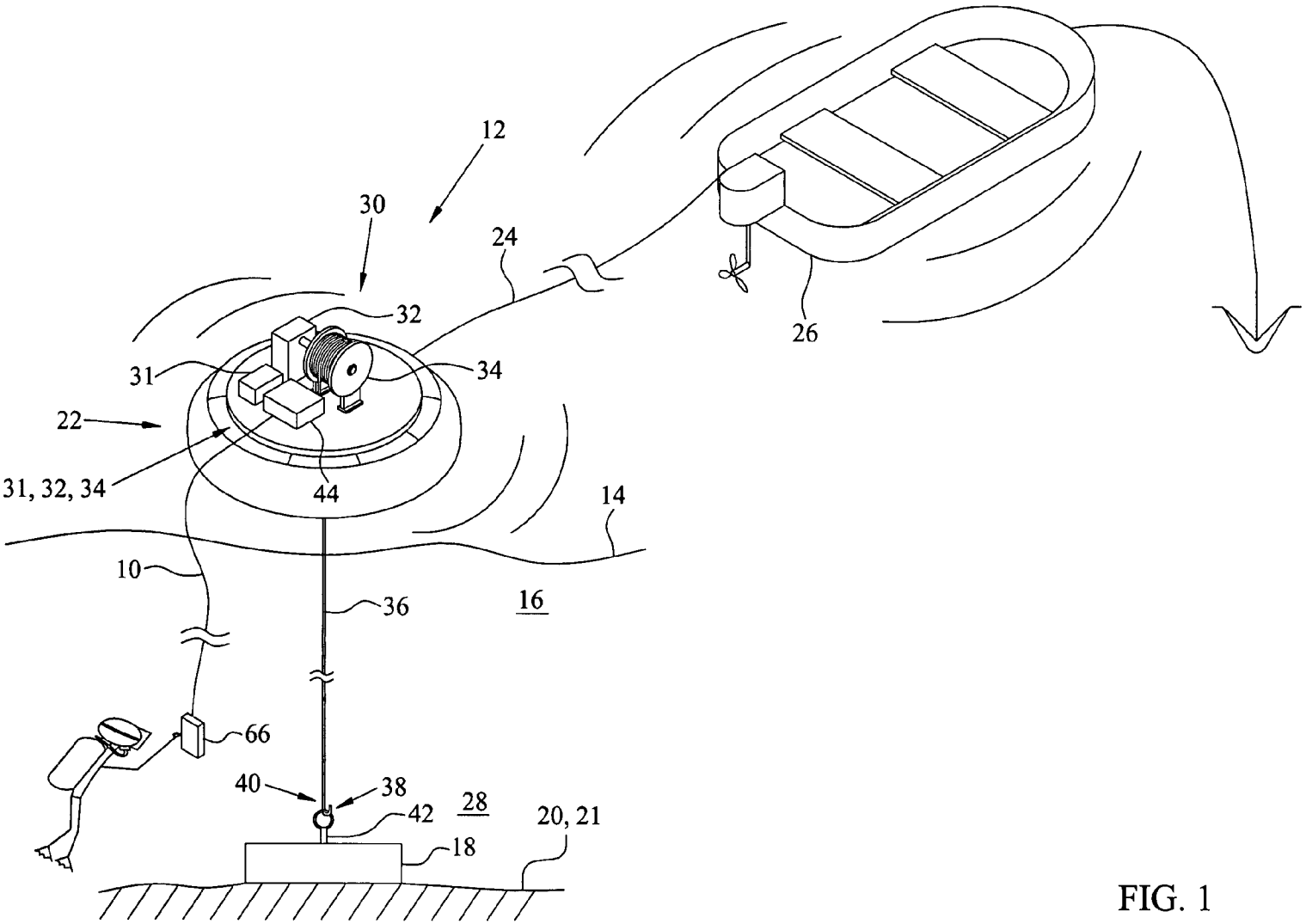
FIG. 1 is an isometric view showing an exemplary deep water lift system interconnected to the remote control pendant of the invention.
Figure 2:
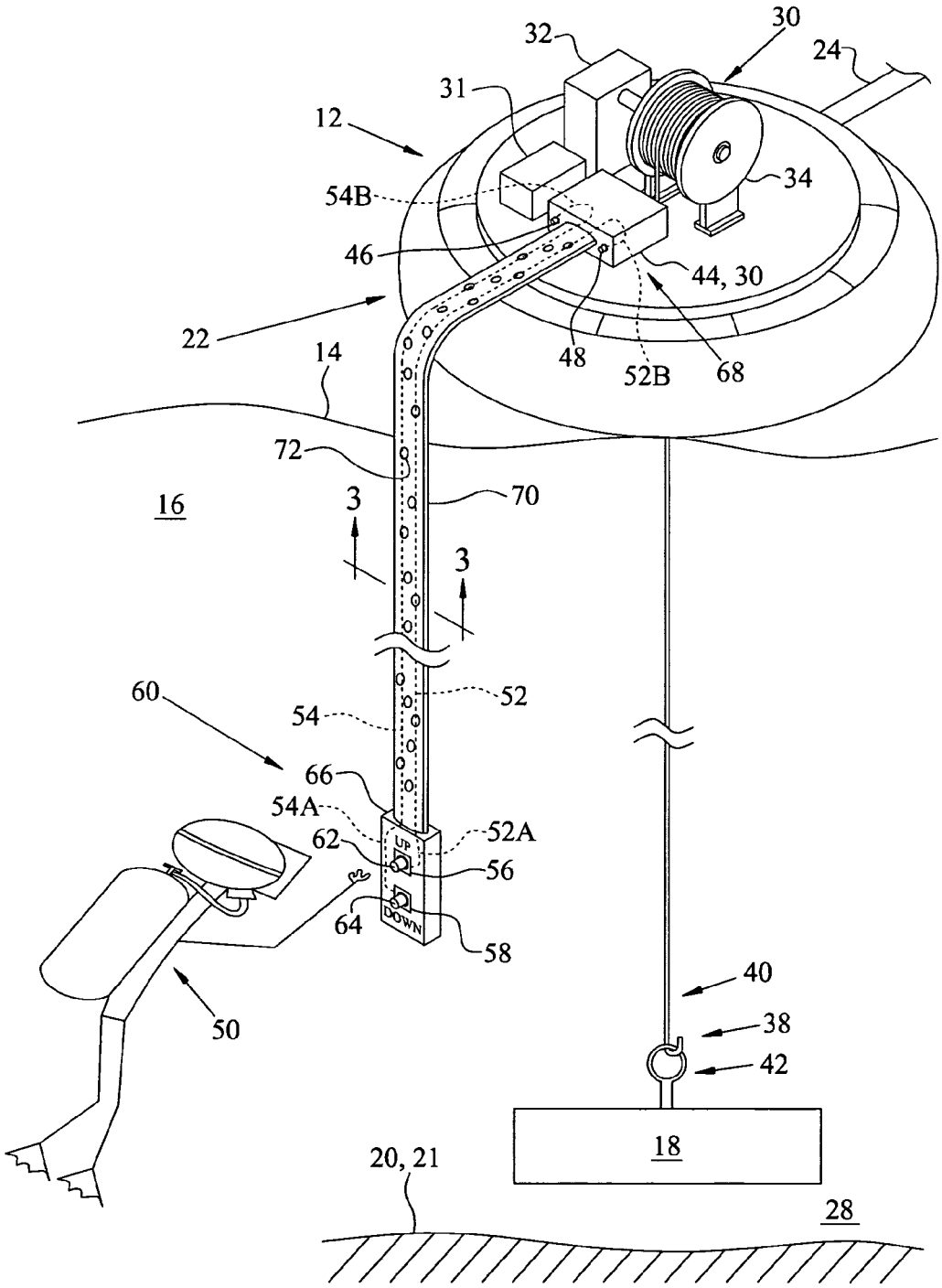
FIG. 2 is an isometric view showing details in an exaggerated relative depiction of the remote control pendant of the invention.

Referring to FIGS. 1 and 2, control pendant 10 of the invention extends from a deep water lift system 12 floating on the surface 14 of a body of water 16 to a submerged object 18 at the bottom 20 or in marine sediment 21 on bottom 20 or other submerged resting place. Object 18 can be, for example, an undersea instrumentation package or console adapted to gather or relay data, machinery, and/or structural members that are to be engaged and raised above bottom 20 for salvage, repair, modification, replacement, or relocated to a different site.

Deep water lift system 12 has a flotation unit 22 that can include reinforced, inflatable, bladder-like chambers, rigid foam-filled or hollow compartments or combinations of these components that float and provide buoyancy at surface 14. Flotation unit 22 can be self-propelled or be towed via tow line 24 by a surface craft 26 to a work site 28 where object 18 is located. Flotation unit 22 has sufficient buoyancy to support on-board hoist machinery 30 and object 18 as hoist machinery 30 raises object 18 from bottom 20 and when it is suspended in water 16.

Hoist machinery 30 has a combination power supply 31, motor 32 and winch 34 operatively coupled together to pay-out and retrieve cable 36 stored on winch 34. Power supply 31 could be batteries when motor 32 is an electric motor or, optionally, could be a tank of petroleum based fuel when motor 32 is a gasoline or diesel engine or turbine, for example. Cable 36 has sufficient length to reach into the depths of water 16 to object 18, and has a coupling device 38 at its distal end 40 to engage a portion 42 of object 18. Coupling device 38 can be hook-like or other well known means for securely engaging object 18 to cable 36.

Hoist machinery 30 also has a control unit 44 connected to the interconnected combination of power supply 31, motor 32, and winch 34. Control unit 44 has a pair of switches 46 and 48 for controlling the amount and polarity of electrical power fed to motor 32. Thus, motor 32 can be controlled by selectively switching or activating switches 46 and 48 to selectively bidirectionally rotate winch 34 and consequently selectively wind-in or pay-out cable 36 to respectively raise or lower object 18.

Systems for underwater salvage have evolved over the years that resemble flotation unit 22 and hoist machinery 30 of deep water lift system 12. A representative contemporary system is set forth in U.S. Pat. No. 5,820,109 assigned to the United States of America, and is remotely operated from the tender or tow craft 26.

Control pendant 10 is operated to control the raising and lowering of object 18 at work site 28 by a percipient diver 50. Control pendant 10 has a pair of insulated electrical control lines 52 and 54 each having a first end 52A or 54A respectively connected to a separate switch 56 or 58 at distal end 60 of control pendant 10. Sealed control buttons 62 and 64 extend through a watertight pendant control housing 66 that contains, protects and seals switches 56 and 58 from the ambient abuses routinely expected during tasks deep in water 16.

The bitter end 68 of control pendant 10 has second ends 52B, and 54B of control lines 52 and 54 electrically connected in parallel with switches 46 and 48 of control unit 44, and couples switches 56 and 58 in housing 66 in parallel with switches 46 and 48 in control unit 44. This parallel connection allows control of selective bidirectional rotation of winch 34 by an operator at the surface on flotation unit 22 by actuation of switches 46 and 48 of control unit 44, and/or allows control of selective bidirectional rotation of winch 34 by diver 50 at site 28 by selective actuation or depression of buttons 62, 64 of switches 56, 58 in control housing 66.

A sleeve-like elongate flexible strength member 70 longitudinally extends the length of control pendant 10. Member 70 resists abrasion, bears the weight of pendant 10 and ancillary tensile loading, and otherwise assures structural integrity. Strength member 70 can be any commercially available flexible, rugged, load-bearing products such as polypropylene, the plastic-like flexible material marked as KEVLAR by DuPont, or strands of stainless steel woven into an outer flexible sleeve.

Figure 3:
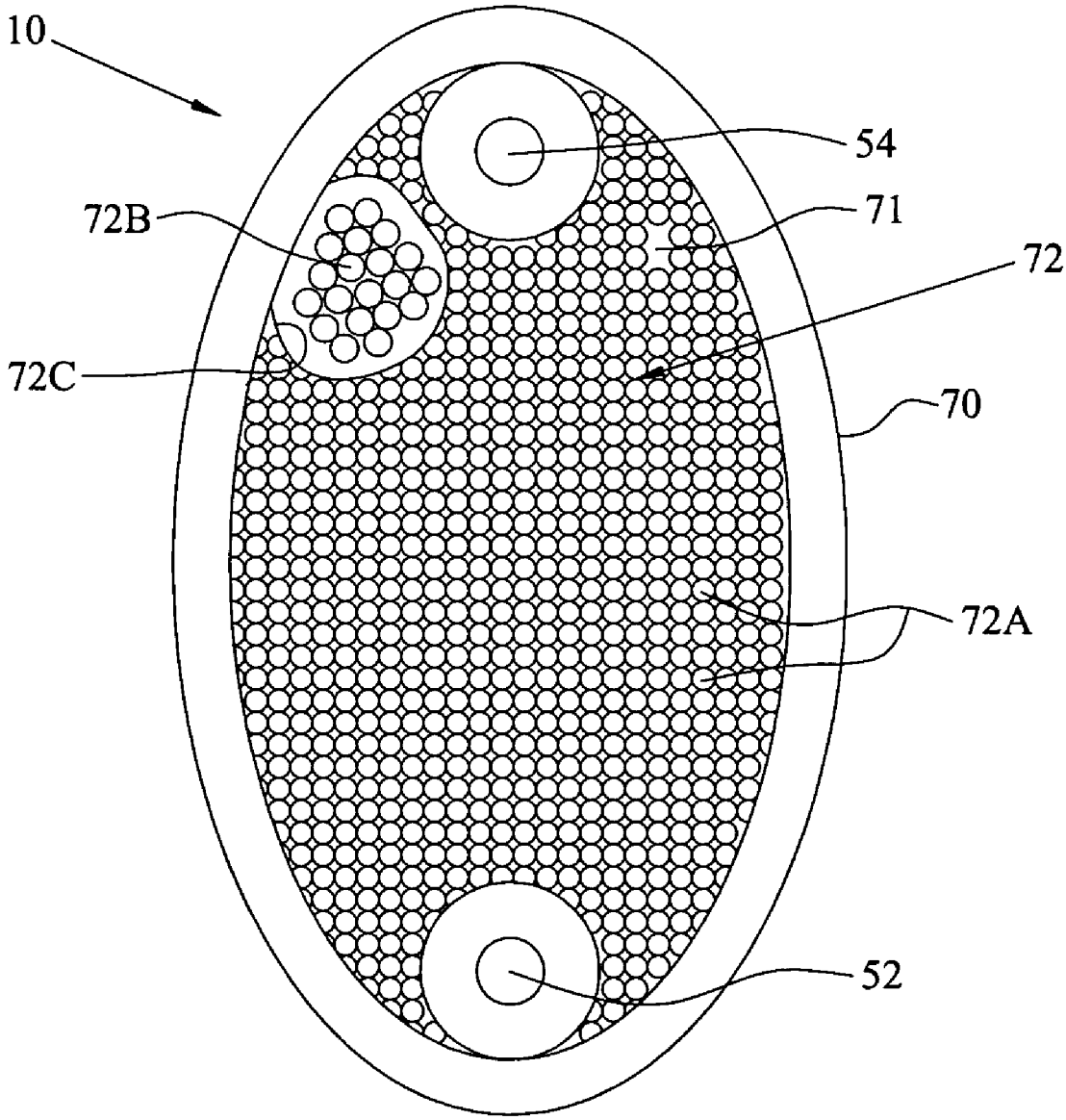
FIG. 3 is a cross-section view of the remote control pendant taken along lines 3-3 in FIG. 2 showing details of the control cable.

Referring also to FIG. 3, strength member 70 is coupled at bitter and distal ends 68 and 60 of pendant 10 to control unit 44 and pendant control housing 66. Strength member 70 has an elongate hollow interior 71 containing control lines 52 and 54 and has the remainder of interior 71 filled with a substantially incompressible filler material 72 that can be dry granulated 72A and/or fluid 72B filler material. Filler material 72A can be selected from a number of commercially available materials such as granulated syntactic foam, grain, sand, etc. Filler material 72B could be a different oils or liquid compounds contained in a sealed septum 72C that create different levels of positive or negative buoyancy. FIG. 3 shows an exemplary filler material 72 having a single septum 72C containing some oil 72B in interior 71 and the rest of interior 71 is filled with dry filler material 72A. It is to be understood that filler material 72 in strength member 70 can be added in different types and different quantities to offset at least some of the negative buoyancy attributed to control lines 52 and 54 and strength member 70 to make control pendant 10 neutrally buoyant, slightly negative (i.e. sinks slowly in water 16 after a few seconds), or more strongly negatively buoyant (i.e. hangs straight down immediately after being deployed in water 16).

Changing buoyancy by selection of filler material 72 increases the usefulness of control pendant 10 in different ambient currents. For example, strong ambient currents at work site 28 could drift or pull a neutrally buoyant control pendant 10 away from work site 28 and/or diver 50 and further complicate a tedious recovery. Under such conditions, a heavier pendant 10 hanging straight down to diver 50 and nearer to object 18 can permit better controlled displacements of object 18.

Optionally, strength member 70 could be at least one cord of suitable strength material (not shown) instead of the sleeve shape. A number of ties (not shown) spaced apart along its length could be used to tie together the cord-like strength member and insulated control lines 52 and 54; however, this configuration exposes the lines to environmental abuses in ambient water 16. Because there is no filler material 72, this embodiment may be more negatively buoyant.

In operation, surface craft 26 can tow floating lift system 12 to position hoist machinery 30 above work site 28 where object 18 is located on bottom 20. A number of anchors and other station-keeping expedients can be relied on to maintain this relative disposition. Hoist machinery 30 pays out enough of cable 36 from flotation unit 22 to extend down through water 16 to object 18. Diver 50 in water 16 at work site 28 engages a portion 42 of object 18 with coupling device 38 to attach cable 16 to object 18.

Diver 50 can withdraw to a safe viewing distance in water 16 from the engaged cable 36 and object 18. In turbid water conditions, this distance may be a few feet, but usually it extends considerably further. This spacing separates diver 50 a safe distance away from object 18 during the hazardous time when vertical loading of cable 36 begins.

The percipient diver 50 raises object 18 from bottom 20 and marine sediment 21 at bottom 20 by pressing control button 62 on pendant control housing 66. Switch 56 couples signals to winch 34 via control unit 44 to reel in lengths of cable 36 until slack is taken up from cable 36. Diver 50 can visually monitor this condition and continue pressing on control button 62 so that winch 34 begins to exert a lifting force on object 18.

The percipient diver 50 controls the rate and/or amount of lifting or raising force that winch 34 exerts. This is accomplished by changing the amount of pressing pressure exerted by diver 50 and consequent displacement of push button 62, or diver 50 can intermittently press button 62. The controllable amount of raising force exerted by winch 34 under the control of diver 50 assures a smooth extraction of object 18 from marine sediment 21 at bottom 20. This smooth extraction avoids the creation of excessive lifting forces and consequent unwanted accelerations that might otherwise be generated during an unobserved raising procedure controlled from the surface.

Once object 18 has been raised off bottom 20, diver 50 can stop the raising of object 18 by releasing all pressure on control button 62 of control pendant 10 and allowing button 62 to return itself to its normal, inactivated centered position. If further raising of object 18 is needed, such as for example to avoid undersea obstacles as object 18 is subsequently taken to a remote destination, diver 50 depresses control button 62 of control pendant 10 as much as needed to cause winch 34 to raise object 18 the required amount to clear the obstacle.

At the intended destination, having control housing 66 of control pendant 10 of the invention in hand, diver 50 can reenter water 16 and approach within visual range of object 18. Taking advantage of the real time control capabilities of control pendant 10, the percipient diver 50 can control a safe lowering of object 18 to bottom 20 or any other resting place by appropriately pressing control button 64 of control housing 66. Button 64 initiates switch 58 to send appropriate signals to winch 34 to lower object 18 in such a controlled fashion to reduce the chances of damaging it or, in the case of unexploded ordnance, causing its untimely detonation.

Control pendant 10 of the invention allows a percipient observer, in this case a diver 50 near bottom 20 and in close proximity to object 18, to control hoist machinery 30. Observed control of object 18 as it is being pulled or extracted from marine sediment 21 on bottom 20 can be critical to avoid the transfer of abrupt or excessive tensile forces to object 18. The transition of object 18 from its position of rest on bottom 20 to motion as it is being raised should be a smooth controlled transition. This smooth transition is assured by diver 50 who monitors the procedure close by so that selective amounts of raising force can be delivered to object 18 via cable 36 without creating snap-like accelerations as object 18 is being lifted from bottom 20 and suspended in water 16.

Having the teachings of this invention in mind, modifications and alternate embodiments of control pendant 10 may be adapted. Control pendant 10 can be fabricated from a wide variety of materials including nonmagnetic materials. It can incorporate more or less switches to initiate other devices topside to assure sufficient strength and long term reliable operation under different operational requirements. Control housing 66 of pendant 10 could have different shapes and other structural members to assure positive mating and interconnection with control lines 52 and 54 and strength member 70.

Control pendant 10 is a rugged, cost-effective, means for assuring real-time control of an object 18 by a percipient diver 50 while it is being raised or lowered in water 16. The disclosed components and their arrangements as disclosed herein, all contribute to the novel features of this invention. Therefore, control pendant 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A method of controlling the raising and lowering of an object in water comprising the steps of:

mounting hoist machinery on a flotation unit, said hoist machinery having operatively interconnected power supply, motor and winch mounting a cable having a coupling device;

floating said flotation unit on water:

positioning said flotation unit above a submerged object;

extending said cable from said hoist machinery to said object;

coupling said coupling device on said cable to said object;

providing two insulated, electrically conductive control lines, said control lines having first and second ends and being of sufficient length to extend from said flotation unit to said object;

coupling said first ends of said control lines to said hoist machinery;

coupling said second ends of said control lines to switches;

covering said control lines within an elongate sheath having first and second ends and an elongate interior volume;

filling the remainder of said elongate interior volume not occupied by said control lines with filler material;

coupling said first end of said sheath to said hoist machinery;

enclosing said switches within a watertight control housing;

coupling said watertight control housing to said second end of said sheath;

extending said control lines, sheath, switches and watertight control housing from said hoist machinery on said flotation unit to said object;

operating said switches to thereby operate said hoist machinery to raise or lower said object while remaining within visual contact range of said object.

2. The method of claim 1 further comprising the step of:

coupling sealed control buttons to said switches and extending said control buttons to the ambient environment on the outside of said watertight control housing.

3. The method of claim 2, whereby said filler material is incompressible.

4. The method of claim 3 further comprising the step of selecting said filler material so that said control lines, sheath, switches and watertight control housing are, collectively, neutrally buoyant.

5. The method of claim 3 further comprising the step of selecting said filler material so that said control lines, sheath, switches and watertight control housing are, collectively, negatively buoyant.

6. A system for controlling the raising and lowering of an object in water comprising:

a flotation unit adapted for floating on water to a position above a submerged object;

hoist machinery mounted on said flotation unit, said hoist machinery having operatively interconnected power supply, motor and winch mounting a cable having a coupling device; and a control pendant having a bitter and distal end, said bitter end being coupled to said hoist machinery, said control pendant having a length sufficient to extend from said flotation unit to said object, said control pendant including:

an elongate sheath defining an elongate interior and extending between said bitter and distal ends, insulated electrically conductive control lines extending within and along the length of said elongate sheath, each said control line having first and second ends, said second end of each said control line being connected to said hoist machinery, filler material filling the remainder of the volume of said elongate sheath not occupied by said control lines, a watertight control housing coupled to said elongate sheath at said distal end, and a pair of switches in said control housing, a separate one of said switches each being connected to a separate one of said first ends of said lines in said housing.

7. The system of claim 6 further comprising:

sealed control buttons extending from said switches in said housing and communicating with the ambient environment outside of said housing.

8. The system of claim 7 wherein said control buttons are adapted for selective depression by a diver positioned within viewing distance of said object so that said selective depression of said control buttons activates corresponding switches on said hoist machinery to thereby enable selective raising and lowering of said object.

9. The system of claim 6 wherein said filler material is incompressible.

10. The system of claim 9 wherein selection of the constituencies of said filler material makes said control pendant negatively buoyant.

11. The system of claim 9 wherein selection of the constituencies of said filler material makes said control pendant neutrally buoyant.

12. The system of claim 8 further comprising:

a control unit at said hoist machinery having a pair of switches coupled to said hoist machinery, said second ends of said control lines being electrically coupled to said switches of said control unit so that said switches in said watertight control housing are connected in parallel with said switches in said control unit, thereby allowing control of selective bidirectional rotation of said winch by an operator at said flotation unit by actuation of said switches of said control unit and allowing control of selective bidirectional rotation of said winch by a diver at said submerged object by actuation of said switches in said control housing.

* * * * *